United States Patent [19]

Unger

[11] Patent Number: 4,642,728

[45] Date of Patent: Feb. 10, 1987

[54] SUPPRESSION OF ELECTROSTATIC CHARGE BUILDUP AT A WORKPLACE

[75] Inventor: Burton A. Unger, Berkeley Heights, N.J.

[73] Assignee: AT&T Bell Laboratories, Murray Hill, N.J.

[21] Appl. No.: 790,801

[22] Filed: Oct. 24, 1985

Related U.S. Application Data

[63] Continuation of Ser. No. 655,767, Oct. 1, 1984.

[51] Int. Cl.[4] ..... H05F 3/04

[52] U.S. Cl. ..... 361/213; 361/231

[58] Field of Search ..... 361/213, 214, 215, 216, 361/231, 235

[56] References Cited

U.S. PATENT DOCUMENTS

| | | | |
|---|---|---|---|
| 3,936,698 | 2/1976 | Meyer | 361/231 |
| 4,068,284 | 1/1978 | Wheeler et al. | 361/213 X |
| 4,110,810 | 8/1978 | Moore et al. | 361/213 |
| 4,213,167 | 7/1980 | Cumming et al. | 361/213 |

OTHER PUBLICATIONS

T. Turner, "Static in a Wafer Fabrication Facility: Causes and Solutions," *Semiconductor International*, Aug. 1983, pp. 122–126.

"Pulsating DC Room Ionization—A Report," Memorex Corporation, Santa Clara, Calif.

A. Steinman, "Clean Room Ionization for ESD Control—A New Approach," (paper presented at 1984 Electrical Overstress Exposition), Apr. 1984, pp. 1–10.

*Primary Examiner*—L. T. Hix

*Assistant Examiner*—Douglas S. Lee

*Attorney, Agent, or Firm*—David I. Caplan

[57] ABSTRACT

In order to suppress electrostatic charge buildup at a workplace, a wire having needle(s) connected thereto and extending vertically downward therefrom is suspended horizontally over the workplace, and a sequence of electrical pulses of alternating polarity is applied to the wire, each of the pulses having a pulse-width of the order of 1 second and a pulse-height of approximately 15 kilovolts.

9 Claims, 1 Drawing Figure

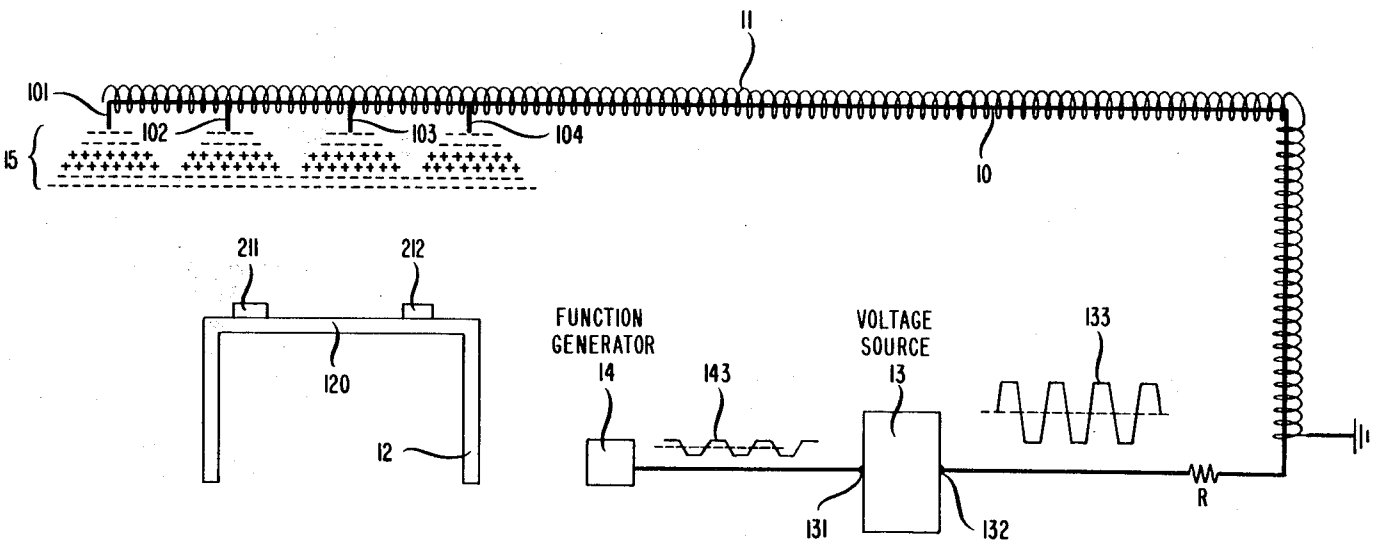
10
11
101
102
103
104
15
212
211
120
12
FUNCTION GENERATOR
14
143
VOLTAGE SOURCE
13
131
132
133
R

SUPPRESSION OF ELECTROSTATIC CHARGE BUILDUP AT A WORKPLACE

This application is a continuation of application Ser. No. 655,767, filed Oct. 1, 1984.

FIELD OF THE INVENTION

This invention relates to methods for suppressing the buildup of electrostatic charge at a workplace, and in particular to methods for suppressing such charge buildup in order to improve the yields of operable semiconductor integrated circuit wafers that are processed at such a workplace.

BACKGROUND OF THE INVENTION

In the manufacture of semiconductor integrated circuits, the semiconductor wafers (typically silicon) subjected to a variety of processing steps at one or more workplace (horizontal) surfaces. During the course of such manufacture, undesirable electrostatic charges of either polarity tend to build up at various locations of the workplace surface proximate to the wafers, whereby the resulting electrostatic fields at the wafers cause undesirable damage to components of the wafers and thus undesirably reduce the yield of operable circuits, for example, by damaging fragile insulating layers embedded in transistor structures within such circuits in the wafers. In addition, electrostatically charged ambient dust particles undesirably tend to cling by electrostatic attraction to exposed surface of the wafers. Such dust particles introduce deleterious defects into the circuits during further processing, so that the yield of oeprable circuits is further undesirably reduced.

In prior art, in order to neutralize such electrostatic charge buildup, workers have injected showers of positive and negative ions into a region located above the workplace from points of metal needles located above the workplace, either by applying to the needles an AC voltage of about 60 cycles so as to produce alternating showers of positive and negative ions from the points of the needles, or by applying a steady DC voltage of positive polarity to some of the needles and a steady DC voltage of negative polarity to the other needles so as to produce simultaneoulsy a steady shower of positive ions and a steady shower of negative ions. In either case, the resulting ions of positive and negative polarity tend to neutralize any buildup of electrostatic charge at the workplace, especially when the showers are sided by a downward airflow coming from above the locations of th eneedles. However, the time it takes in either case (AC or DC) for this neutralizing electrostatic charge buildup at the workplace is unduly long, probably because of the recombination of too many of the positive and negative ions before they reach the workplace surface, and accordingly the suppression of electrostatic charge buildup at the workplace surface is not as effective as desired.

It would, therefore, be desirable to have a method for more effectively suppressing electrostatic charge buildup at a workplace and hence for improving the yield of operable semiconductor integrated circuit wafers that are processed thereat.

SUMMARY OF THE INVENTION

Electrostatic charge buildup of either polarity at a workplace can be more quickly neutralized by injecting alternating showers of negative and positive ions into a region of ambient atmostphere located above the workplade, each of the showers being generated during a separate time interval of the order of 1 second in duration.

In a specific embodiment of the invention, a wire is suspended above and parallel to a workplace (horizontal) surface. A plurality of metal needles is electrically connected to the wire, and the wire is alternately pulsed positively and negatively by a pulse sequence of alternating polarity each of whose pulses has a pulse-width (pulse time duration) of about 1 second and a pulse-height (amplitude) of about 15 kilovolts. In this way, the time it takes for an electrostatic charge buildup to decay to the fraction (1/e)'th of its inital value is only about 10 or 20 seconds or less, the dust count in the ambient at the workplace has been measured as having been reduced on the average by a factor of about 2, the dust count on a silicon semiconductor wafer at the workplace has been measured as having been reduced on the average by a factor of about 7, and hence the yield of operable semiconductor integrated circuits that are processed thereat is expected to improve significantly.

BRIEF DESCRIPTION OF THE DRAWING

This invention together with its features, advantages, and characteristics may be better understood from the following detailed description when read in conjunction with the drawing in which the FIGURE illustrates a method for suppressing electrostatic charge buildup at a workplace in accordance with a specific embodiment of the invention.

DETAILED DESCRIPTION

Upon a workplace surface 120 on the top of a work table 12 is located one or more workpieces 211, 212, . . . , such as semiconductor wafers being processed. Above the table is suspended a horizontal high voltage wire portion 10 around which is coiled a grounded wire portion 11 (to furnish an electrical shield for the high voltage wire). The wire 10 is connected through a resistor R, typically approximately 50 megohms, to an output terminal 132 of a voltage source 13, typically a TREK Model 620 power supply (amplifier) commercially available from Trek, Incorporated, 1674 Quaker Road, Barker, N.Y. 14012–9990. The resistor R serves to suppress excessive currents and shocks to people accidentally touching a needle. An input (control) terminal 131 of the voltage source 13 is connected to a programmable function generator 14, such as Model 3314A available from Hewlett Packard Co. The function generator is programmed to provide a suitable control signal 143 to the voltage source 13, whereby the voltage source 13 applies to the wire 10 a suitable voltage pulse sequence 133 as more fully described below.

The horizontal wire portion 10 is connected at one or more locations to one or more metal needles 101, 102, 103, 103, . . . , each typically made of tungsten and oriented toward the vertically downward direction, whereby in response to a sequence of suitable voltage pulses of alternating polarity applied by the source 13 to the wire 10 a shower 15 of ions of the corresponding alternating polarity is generated by and dishcarged from the needle(s). These ions ultimately descend to the workplace surface 120 and the workpiece(s) 121, 122, . . . , to neutralize static charges thereat. The high voltage wire 10 and the needle(s) are both electrically insulated from the grounded wire 11, as by a layer of insulation (not shown) surrounding the grounded wire.

In a typical example for illustrative purposes, each of the needles 101, 102, 103, 104, . . . , is separated from its nearest neighboring needle (if any) by approximately 1.5 feet in areas overlying the floor (a main aisle) where people are working or moving about, and approximately 3 feet elsewhere (areas overlying the workplace surfaces). Suitable needles are the Model 1026-05 QM obtainable from Moser Jewel Co., Perth Amboy, N.J. Suitable wire for the wires 10 and 11 is No. R790-3516 (16 AWG) obtainable from Rowe Industries, Toledo, Ohio. The blunt end of each needle is inserted through the insulation (not shown) of the high voltage wire 10, whereby electrical contact is made between each needle and the high voltage wire 10. The height of the workplace surface 120 from the floor (not shown) supporting the table 12 is approximately 3 feet. The room containing the workplace extends approximately 10 feet in the direction perpendicular to the plane of the FIGURE, and the wire portion 10 forms a rectangular loop having a pair of elongated parallel sides suspended in a plane parallel to, and located approximately 1 foot below, the ceiling, whereby the corresponding pair of elongated wire portions are spaced apart by a distance of approximately 4 feet, and whereby each such elongated wire portion is located at a distance of approximately 3 feet from a respective proximate wall of the room. The height of the room is approximately 10 feet from floor to ceiling.

The function generator 14 is programmed to supply the control signal 143. This programming is adjusted so that the height (amplitude) of each pulse in the control signal 143 is such that the height of each pulse in the sequence 133 is approximately ±15 kilovolts, and so that each pulse in the sequence 133 has a rise and fall time of typically approximately 80 milliseconds (i.e., the time it takes for the voltage to attain its maximum magnitude, positive or negative, after crossing the zero level represented by the horizontal dotted line). Thus, each pulse in the sequence 133 has a trapezoidal waveform profile, characterized by a flat top (or bottom) and by a substantially linear rmap of approximately 80 milliseconds time duration at the beginning and end of each pulse. Accordingly, for a voltage source 13 having an amplification of about 2,000, the function generator 14 is programmed with an input program signal (not shown) having the same trapezoidal waveform as a function of time as that desired for the pulse sequence 133, except that the amplitude of the program signal is adjusted so that the amplitude of the pulses of the control signal 143 is only about 7.5 volts (7.5 volts×2,000=15 kilovolts).

A ramp time duration in the approximate range of 50 to 150 milliseconds and a pulse height in the approximate range of 10 to 20 kilovolts are also useful. This ramp serves to prevent an undesirably high spike current, which otherwise may impose undesirably high current loads on the voltage source, and also serves to impose a slight pause between alternating positive and negative ion showers—in order to suppress excessive recombination of ions of opposite polarity, by giving the ions of one polarity an opportunity to fall away from the needles before ions of the ohter polarity are injected from the same needles, the voltage threshold for ion injection being approximately 6 kilovolts.

The width (time duration) of each pulse in the sequence 133 (and hence also in the sequence 143) is approximately 0.75 second, with a useful range of approximately 1/5 to 4 second. The grounded wire 11 serves to suppress undesirable fields emanating from the high voltage wire 10. The grounded wire 11 (insulated from the needles and the high voltage wire) is coiled around the high voltage wire 10 with approximately 6 or 7 turns per foot, so that most of the electric field lines emanating from the wire 10 terminate in the grounded wire 11, whereby the electrical potential to which people working in the room may become charged by induction is significantly reduced.

During operation, the function generator 14 supplies to the input control terminal 131 the pulse sequence control signal 143 of the same waveform profile as the sequence 133 desired on the wire 10 (including ramps) but at a much lower voltage level, typically approximately ±7.5 volts peak. In response thereto, the voltage source 13 (having an amplification factor of about 2,000) supplies the output terminal 132, and hence the wire 10, with the pulse sequence 133 of relatively high voltage level, that is, ramped pulses of alternating polarity with the same profile as that of the control signal 143 but with pulse heights of approximately ±15 kilovolts. In this way, the corresponding shower 15 of ions of alternating polarity is generated by the needles 101, 102, 103, 104, . . . , as desired in the practice of the invention.

Although the invention has been described in detail with respect to a specific embodiment, various modifications can be made without departing from the scope of the invention. For example, pauses (at zero voltage level) of a duration of the order of 0.1 second, between termination and commencement of successive pulses, can be introduced into the pulse sequence 133 by introducing the same puases into the control signal 143 (in turn by introducing the same puases into the input program signal for programming the function generator 14), in order to give the ions a further opportunity (in addition to the ramp time) to fall away from the needles before ions of opposite polarity are injuected by the same needles. Instead of (or in addition to) the resistor R, each needle can be connected to the wire 10 through a separate resistor, in order to provide better current-limiting in case of accidental human touching of a needle. Finally, an electrostatic probe can be located on the workplace surface and can be connected to the function generator 14 in a conventional negative feedback arrangement so as to modify (from unity) the ratio of the height of the positive pulses to the height of the negative pulses supplied by the voltage source 13, whereby detection by the probe of a buildup of positive electrostatic charge reduces the height of the positive pulses while it increases the height of the negative pulses, whereas detection of negative charge increases the height of the positive pulses while it reduces the height of the negative pulses; that is, in either case the zero voltage lever (represented by the dotted lines in the FIGURE) of the pulse sequence 133 is shifted upwards or downwards by an auxiliary input (not shown) to the voltage source 13, so as to suppress the electrostatic charge detected at the probe.

What is claimed is:

1. A method for processing a workpiece at a workplace comprising injecting successive showers alternately of positive and negative ions into a region of ambient atmosphere located above the workplace while the workpiece is located on a surface of the workplace for being processed thereat, each of the showers being generated during a separate time interval of the order of 1 second in duration whereby electrostatic charge buildup on the workpiece is suppressed by the showers.

2. In a method of manufacturing a circuit integrated in a semiconductor wafer the steps of: injecting successive showers alternately of positive and negative ions into a region of ambient atmosphere located above the workplace, each of the showers being generated during a separate time interval of the order of 1 second in duration while the wafer is located on a surface of the workplace; and processing the wafer thereat during said injecting.

3. A method for processing a workpiece at a workplace the comprising the steps of: applying a sequence of electrical pulses of alternating polarity to one or more needles, located above the workplace, for injecting ions, in response to the pulses, into the ambient atmosphere of the workpiece while located at the workplace,; and processing the workpiece while said pulses are being applied, each of the pulses having a pulse-width of the order of 1 second whereby electrostatic charge buildup on the workpiece is suppressing by the ions.

4. The method of claim 3 in which the pulses are of alternating polarity.

5. The method of claim 4 in which the width of each pulse is in the approximate range of 1/5 to 4 seconds.

6. A method for processing semiconductor wafers at a workplace comprising the steps of: applying a sequence of electrical pulses of alternating polarity to one or more needles, located above the workplace, for injecting ions, in response to the pulses, into the ambient atmosphere of the wafers while located at the workplace, each of the pulses having a pulse-width of the order of 1 second whereby electrostatic charge buildup at the workplace is suppressed by the ions while the wafers are located thereat; and processing the wafers thereat while said pulses are being applied.

7. The method of claim 6 in which the pulses are of alternating polarity.

8. The method of claim 7 in which the width of each pulse is in the approximate range of 1/5 to 4 seconds.

9. The method of claim 6 in which the width of each pulse is in the approximate range of 1/5 to 4 seconds.

* * * * *